US005922654A

United States Patent [19]

Yamazaki et al.

[11] Patent Number: 5,922,654

[45] Date of Patent: Jul. 13, 1999

[54] LUBRICANT COMPOSITION

[75] Inventors: Masahiko Yamazaki; Jun Kuraishi; Kenichi Iso; Atsushi Yokouchi; Michiharu Naka, all of Kanagawa, Japan

[73] Assignee: NSK Ltd., Tokyo, Japan

[21] Appl. No.: 08/860,296

[22] PCT Filed: Oct. 22, 1996

[86] PCT No.: PCT/JP96/03071

§ 371 Date: Jun. 23, 1997

§ 102(e) Date: Jun. 23, 1997

[87] PCT Pub. No.: WO97/15644

PCT Pub. Date: May 1, 1997

[30] Foreign Application Priority Data

| | | | |
|---|---|---|---|
| Oct. 23, 1995 | [JP] | Japan | 7/297284 |
| Sep. 11, 1996 | [JP] | Japan | 8/261197 |
| Sep. 11, 1996 | [JP] | Japan | 8/261199 |

[51] Int. Cl.[6] ..... C10M 135/18; C10M 137/00

[52] U.S. Cl. ..... 508/364; 508/272

[58] Field of Search ..... 508/364, 272

[56] References Cited

U.S. PATENT DOCUMENTS

| | | | |
|---|---|---|---|
| 2,265,851 | 12/1941 | Matheson | 508/364 |
| 3,412,026 | 11/1968 | Booker | 508/364 |
| 3,513,094 | 5/1970 | Farmer et al. | 508/364 |
| 4,466,895 | 8/1984 | Schroeck | 508/368 |
| 4,501,678 | 2/1985 | Katayama et al. | 508/364 |
| 4,551,258 | 11/1985 | Ikeda et al. | 508/377 |
| 4,648,985 | 3/1987 | Thorsell et al. | 508/364 |
| 4,764,294 | 8/1988 | Habeeb et al. | 508/365 |
| 4,840,740 | 6/1989 | Sato et al. | 508/364 |
| 5,356,547 | 10/1994 | Arai et al. | 508/365 |

FOREIGN PATENT DOCUMENTS

| | | |
|---|---|---|
| 52-24203 | 2/1977 | Japan . |
| 59-11397 | 1/1984 | Japan . |
| 60-19793 | 1/1985 | Japan . |
| 60-47099 | 3/1985 | Japan . |
| 63-46299 | 2/1988 | Japan . |
| 3122193 | 5/1991 | Japan . |
| 368920 | 10/1991 | Japan . |
| 434590 | 6/1992 | Japan . |
| 579280 | 11/1993 | Japan . |

*Primary Examiner*—Jacqueline V. Howard
*Attorney, Agent, or Firm*—Sughrue, Mion, Zinn, Macpeak & Seas, PLLC

[57] ABSTRACT

The invention relates to lubricant compositions which contain (1) specific organometallic compounds, or (2) a specific organometallic compound and an ashless sulfur compound, or (3) an organomolybdenum compound and an ashless sulfur compound having a specific group, or (4) a specific organometallic compound and a phosphorus compound, or (5) an organonickel compound, or (6) a specific organometallic compound. The lubricant compositions of the invention not only can impart far higher load bearing properties and extreme-pressure properties than conventional ones to members to which the compositions are applied, but also show an excellent lubricating performance at high temperatures.

9 Claims, No Drawings

LUBRICANT COMPOSITION

This application is a 371 of PCT/JP96/03071 filed Oct. 22, 1996.

TECHNICAL FIELD

The present invention relates to lubricant compositions for application to rotating members and sliding members of various industrial machines, vehicles, etc. In particular, this invention relates to lubricant compositions which are suitable for application to parts required to have load bearing properties and extreme-pressure properties or parts susceptible to wear, such as parts placed under a high load or having a high specific sliding, and are also suitable for application to machines and apparatus which are used at high temperatures.

More specifically, the present invention relates to lubricant compositions which are suitable for use as greases to be applied to rolling mechanical parts and mechanical parts which roll while sliding, such as rolling bearings, e.g., tapered roller bearings and four-point contact ball bearings, constant-velocity joints (CVJ), linear guides (L/G) for use in positioning apparatus, ball screws (B/S), and cross roller bearings for use in megatorque motors, for the purposes of improving the seizure resistance of rolling parts and parts which roll while sliding (hereinafter referred to as rolling/sliding parts), inhibiting the heat generation caused by sliding friction, etc., and are also suitable for use as various lubricating oils such as engine oils and gear oils.

BACKGROUND ART

Greases as a kind of lubricant compositions are being extensively used for rolling members and sliding members of various industrial machines, vehicles, etc. However, especially in the aforementioned apparatus which are used under a high load or have rolling/sliding parts required to be lubricated, if the use conditions therefor become severe (load increase, oil film deficiency due to sliding friction, etc.), the lubrication of the rolling parts thereof, in particular, the rolling/sliding parts thereof, is apt to become boundary lubrication. As a result, galling, seizure due to thermal deterioration of the lubricant, etc. occur to significantly reduce the lubricity life of the parts. For maintaining satisfactory lubrication in such environments, it is indispensable to improve lubricity life by improving load bearing properties or reducing frictional resistance to inhibit heat generation, but the attainment thereof largely depends on the properties of greases.

For example, in tapered roller bearings, the lubricity life of the inner-ring cone back face rib and of the edge of each roller, which bear an axial load, becomes a problem. Namely, since the life of a tapered roller bearing is considerably influenced by the sliding speed and the contact area pressure at the rib, the grease used therein is required to inhibit heat generation and have load bearing properties. In a CVJ, a rolling/sliding movement occurs because the driving shaft on the differential gear side forms an angle with the idler shaft on the wheel side. For the reason, the lubrication in a CVJ is apt to become boundary lubrication and the friction generated therein influences the efficiency of power transmission and heat generation. Hence, use of a grease effective in improving frictional properties and inhibiting heat generation improves the performance of a CVJ and leads to the prolongation of durability life.

A generally employed expedient for mitigating the problem described above is to incorporate an extreme-pressure additive to a grease. Known extreme-pressure additives for greases include solid lubricants such as $MoS_2$, sulfur, phosphorus, or sulfur-phosphorus organic compounds, organomolybdenum compounds such as a molybdenum dialkyldithiocarbamate (MoDTC) and a molybdenum dialkyldithiophosphate (MoDTP), and a zinc dialkyldithiophosphate (ZnDTP). MoDTC's, MoDTP's, and ZnDTP's are regarded as more effective than $MOS_2$ and sulfur-phosphorus organic compounds.

Many proposals have been disclosed on the technique of incorporating extreme-pressure additives comprising organomolybdenum compounds or ZnDTP's into greases to obtain grease compositions having different properties according to the intended uses. For example, Examined Japanese Patent Publication No. 5-79280 discloses a technique of adding an MoDTC and an MoDTP to a urea grease to give a grease composition having reduced coefficient of friction, which is especially effective for improving the properties of plunging type CVJ's. Examined Japanese Patent Publication Nos. 4-34590 and 3-68920 and Unexamined Published Japanese Patent Application No. 60-47099 contain a description to the effect that extreme-pressure agents comprising an organomolybdenum or organozinc compound such as an MoDTC, MoDTP, or ZnDTP are especially effective.

It is further known that organoantimony compounds and ashless dialkylcarbamic acids are also effective.

On the other hand, greases comprising a mineral oil as the base oil have a drawback that they are more susceptible to oxidation than greases comprising as the base oil a synthetic lubricating oil, e.g., an ester oil, silicone oil, or ether oil, and in particular have a short lubricity life at high temperatures. Further, greases containing a lithium soap as a thickener, which are widely used as general-purpose greases, come to have a reduced oil-retaining ability at 130° C. or higher because the grease structure thereof is destroyed at such high temperatures. Long-term use of these soap-containing greases results in a considerable decrease in lubricating action because the oxidation of the base oil is accelerated mainly by the catalytic function of the metal element contained in the soap.

In addition, once a grease is applied to various machines and apparatus, it is mostly used over a long period while being always in contact with air. Therefore, such a grease is desired to have better thermal and oxidative stability. From this point of view, as for bearings to be used at high temperatures and high speeds, a grease comprising a combination of a synthetic lubricating oil such as the aforementioned ones and a urea compound, which has excellent thermal and oxidative stability, is generally used.

As described above, maintenance cost has recently come to be taken in account, and with the recent trend toward size reduction and performance enhancement in apparatus, the use conditions therefor tend to become severer. With these trends, lubricant compositions are required to have a higher lubricating performance and a longer lubricity life.

However, the lubricant compositions containing an organomolybdenum compound, organozinc compound, organoantimony compound, or the like, which have hitherto been regarded preferable, cannot fully satisfy such a desire. In addition, the range of parts to which those prior art lubricant compositions are not applicable is increasing.

The present invention has been achieved in view of the circumstances described above. An object of the present invention is to provide lubricant compositions which have better load bearing properties and extreme-pressure properties than conventional ones, show an excellent lubricating performance at high temperatures, and prolong the lubricity life of parts lubricated therewith.

DISCLOSURE OF THE INVENTION

The object described above is accomplished with the following lubricant compositions according to the present invention.

(1) A lubricant composition characterized by containing two or more organometallic compounds selected from organometallic compounds wherein the metal is a transition metal or semimetal belonging to the fourth or a later period of the periodic table in the longer form, copper, molybdenum, or zinc (hereinafter referred to as the first lubricant composition).

(2) A lubricant composition characterized by containing at least one organometallic compound selected from organometallic compounds wherein the metal is a transition metal or semimetal belonging to the fourth or a later period of the periodic table in the longer form or copper, and further containing a sulfur compound containing no metal elements (hereinafter referred to as the second lubricant composition).

(3) A lubricant composition characterized by containing an organomolybdenum compound and at least one of sulfur compounds which have at least one of a thiazole group, a thiourea group, a thiocarbamoyl group, an imido group, and a carboxyl group and contain no metal elements (hereinafter referred to as the third lubricant composition).

(4) A lubricant composition characterized by containing at least one organometallic compound wherein the metal is a transition metal or semimetal belonging to the fourth or a later period of the periodic table in the longer form or copper, and further containing a phosphorus compound (hereinafter referred to as the fourth lubricant composition).

(5) A lubricant composition characterized by containing an organonickel compound (hereinafter referred to as the fifth lubricant composition).

(6) A lubricant composition characterized by containing at least one organometallic compound wherein the metal is selected from tellurium, selenium, copper, and iron (hereinafter referred to as the sixth lubricant composition).

BEST MODES FOR CARRYING OUT THE INVENTION

The lubricant compositions of the present invention are explained below in detail.

(First Lubricant Composition)

The first lubricant composition according to the present invention is characterized by containing two or more organometallic compounds selected from organometallic compounds wherein the metal is a transition metal or semimetal belonging to the fourth or a later period of the periodic table in the longer form, copper, molybdenum, or zinc.

The transition metal belonging to the fourth or a later period of the longer-form periodic table is a metal belonging to Group VIII of the periodic table, while the semimetal is an element belonging to any of Groups IVB to VIIB and selected from Ge, As, Se, Sn, Sb, Te, Bi, Po, and At.

As the organometallic compound, organic acid metal salt compounds, complex salt compounds, coordination compounds, addition compounds, alkylmetal compounds, metallic acid esters, and metal alkoxides, each containing any of the aforementioned metals, can be preferably used. As the organic acid metal salt compounds, organic carboxylic acid compounds, organic sulfur acid compounds, and organic phosphoric acid compounds are preferred. Especially preferred are the dithiocarbamic acid compounds and dithiophosphoric acid compounds represented by the following general formula (I) or (II).

(I)

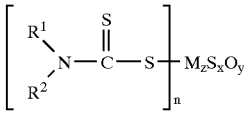

(II)

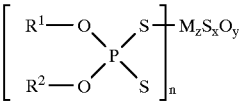

n = 2, 3, 4 x, y, z = 0, 1, 2, 3, 4

In general formulae (I) and (II), M is any of the aforementioned metals, but preferably antimony, bismuth, tin, nickel, tellurium, selenium, iron, copper, molybdenum, or zinc.

$R^1$ and $R^2$ may be the same or different, and each represents an alkyl group, a cycloalkyl group, an alkenyl group, an aryl group, an alkylaryl group, or an arylalkyl group. Especially preferred groups include 1,1,3,3-tetramethylbutyl, 1,1,3,3,-tetramethylhexyl, 1,1,3-trimethylhexyl, 1,3-dimethylbutyl, 1-methylundecane, 1-methylhexyl, 1-methylpentyl, 2-ethylbutyl, 2-ethylhexyl, 2-methylcyclohexyl, 3-heptyl, 4-methylcyclohexyl, n-butyl, isobutyl, isopropyl, isoheptyl, isopentyl, undecyl, eicosyl, ethyl, octadecyl, octyl, cyclooctyl, cyclododecyl, cyclopentyl, dimethylcyclohexyl, decyl, tetradecyl, docosyl, dodecyl, tridecyl, trimethylcyclohexyl, nonyl, propyl, hexadecyl, hexyl, heneicosyl, heptadecyl, heptyl, pentadecyl, pentyl, methyl, tert-butylcyclohexyl, tert-butyl, 2-hexenyl, 2-methallyl, allyl, undecenyl, oleyl, decenyl, vinyl, butenyl, hexenyl, heptadecenyl, tolyl, ethylphenyl, isopropylphenyl, tert-butylphenyl, sec-pentylphenyl, n-hexylphenyl, tert-octylphenyl, isononylphenyl, n-dodecylphenyl, phenyl, benzyl, 1-phenylethyl, 2-phenylethyl, 3-phenylpropyl, 1,1-dimethylbenzyl, 2-phenylisopropyl, 2-phenylhexyl, benzhydryl, and biphenyl groups. These groups may have one or more ether bonds.

As the organic acid metal salts other than the compounds represented by general formulae (I) and (II), the salts of 2-mercaptobenzothiazole with the aforementioned metals can be preferably used.

Further, the salts of the aforementioned metals with naphthenic acids or fatty acids are also preferred.

In the case where an organoselenium compound which is used as an alkylmetal compound, the compound is preferably phenoselenazine, diphenyl selenide, or the like.

A mixture of two or more of the organometallic compounds enumerated above is added to a lubricant composition. The addition amount thereof varies depending on the kind of the lubricant composition, the intended application parts, etc. For example, in the case of a grease for bearings, the addition amount thereof is from 0.3 to 20% by weight, preferably from 0.3 to 12% by weight.

If the addition amount thereof is smaller than the lower limit, a sufficient effect is not obtained. Even if the amount thereof is increased beyond the upper limit, not only a further improvement in effect cannot be expected, but there is a possibility that the wear of the lubricated part, e.g., a bearing, proceeds due to a chemical action, etc., resulting in reduced durability of the lubricated part, far from improving durability.

Combinations of the organometallic compounds enumerated above are not particularly limited. It is however preferred to use (1) a combination of an organoantimony compound and an organotin compound or (2) a combination comprising a mixture of at least one organometallic compound, as an essential ingredient, selected from organoantimony compounds and organobismuth compounds with at least one member selected from organotellurium compounds and organonickel compounds.

The organometallic compounds may be mixed in any desired proportion, but they are preferably mixed almost in the same amount.

(Second Lubricant Composition)

The second lubricant composition according to the present invention is characterized by containing at least one organometallic compound selected from organometallic compounds wherein the metal is a transition metal or semimetal belonging to the fourth or a later period of the periodic table in the longer form or copper, and further containing a sulfur compound containing no metal elements (ashless sulfur compound). The transition metal or semimetal belonging to the fourth or a later period of the longer-form periodic table has the same meaning as the transition metal or semimetal in the first lubricant composition described above.

The organometallic compounds for use in the second lubricant composition are the same as part of the organometallic compounds for use in the first lubricant composition described above, that is, the organometallic compounds wherein the metal is a transition metal or semimetal belonging to the fourth or a later period of the longer-form periodic table or copper. Especially preferred are the dialkyldithiocarbamic acid compounds and dithiophosphoric acid compounds represented by the following general formulae (III) and (IV) wherein M is nickel, tellurium, selenium, antimony, tin, bismuth, copper, or iron, naphthenic acid compounds, and fatty acid compounds.

(III)

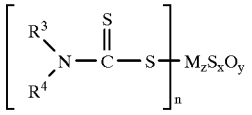

(IV)

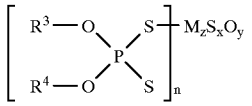

n = 2, 3, 4
x, y, z = 0, 1, 2, 3, 4

In general formulae (III) and (IV), M is a metal, and $R^3$ and $R^4$ have the same meanings as $R^1$ and $R^2$ in general formulae (I) and (II).

The above organic compounds are added alone or as a mixture of two or more thereof to a lubricant composition. In the case of preparing a mixture to be added, combinations of those organic compounds are not particularly limited.

The addition agent thereof varies depending on the kind of the lubricant composition, the intended application parts, etc. For example, in the case of a grease for bearings, the addition amount thereof is from 0.3 to 20% by weight, preferably from 0.3 to 12% by weight. If the addition amount thereof is smaller than the lower limit, a sufficient effect is not obtained. Even if the amount thereof is increased beyond the upper limit, not only a further improvement in effect cannot be expected, but there is a possibility that the wear of the lubricated part, e.g., a bearing, proceeds due to a chemical action, etc., resulting in reduced durability of the lubricated part, far from improving durability.

On the other hand, preferred examples of the ashless sulfur compound to be used in the second lubricant composition include compounds containing no metal elements (ashless compounds) such as thiol type, thiazole type, sulfenamide type, sulfonamide type, mercapto type, mercaptobenzimidazole type, thiourea type, thiuram type (thiocarbamoyl type), dithiocarbamic acid type, thiophthalimide type, thiopropionic acid type, thiadiazole type, sulfide type, polysulfide type, thiophthalimide type, thiophosphoric acid type, dithiophosphoric acid type, thioaldehyde type, thioketone type, thioacetal type, thiocarboxylic acid type, xanthogenic acid type, and organic sulfur acid type compounds. It is especially preferred to use a carbamic acid type ashless sulfur compound.

Preferred ashless sulfur compounds are shown below.

Usable examples thereof include thiocarbanilide, 4,4'-methylenebis(cyclohexyl carbamate), 4,4'-methylenebis (dibutyl dithiocarbamate), pentamethylenedithiocarbamic acid piperazine salt, pentamethylenedithiocarbamic acid piperidine salt, pipecolyldithiocarbamic acid pipecoline salt, 2-mercaptomethylbenzimidazole, 2-mercaptotoluimidazole, N-trichloromethylthio-4-cyclohexane-1,2-dicarboximide, 2,5-dimercapto-1,3,4-thiadiazole, dipentamethylenethiuram tetrasulfide, 1,3,4-thiadiazole, 4-morpholinyl-2-benzothiazole disulfide, N,N'-dicyclohexyl-2-benzothiazolesulfenamide, 2-(4-morpholinyldithio) benzothiazole, 2-benzothiazolyl disulfide, N-tert-butylbenzothiazolesulfonamide, N-oxydiethylene-2-benzothiazolesulfonamide, N-cyclohexyl-2-benzothiazolesulfonamide, 2-mercaptobenzothiazole sodium salt, 2-(4'-morpholinodithio)benzothiazole, 2-mercaptobenzothiazole, N-cyclohexyl-2-benzothiazolylsulfenamide, N-t-butyl-2-benzothiazolylsulfenamide, N,N'-dicyclohexyl-2-benzothiazolylsulfenamide, N-tert-butyl-2-benzothiazolesulfenamide, dibenzothiazyl disulfide, tetrakis (2-ethylhexyl)thiuram disulfide, tetrabutylthiuram disulfide, tetramethylthiuram disulfide, tetraethylthiuram disulfide, dipentamethylenethiuram tetrasulfide, tetrabenzylthiuram disulfide, tetramethylthiuram monosulfide, tetrathiuram monosulfide, diethylthiourea, dilaurylthiourea, 2-mercaptothiourea, dibutylthiourea, dimethylthiourea, di-o-toluylthiourea, N,N'-diphenylthiourea, distearyl 2,2'-thiodibutyrate, distearyl thiopropionate, dilauryl 3,3'-thiopropionate, dimyristyl thiopropionate, dilauryl tripropionate, distearyl 3,3'-thiopropionate, ditridecyl thiopropionate, hexahydro-1,3,5-triethyl-s-triazine, 2-hydroxy-4-methoxy-5-sulfobenzophenone trihydrate, 2,5-bis[5'-tert-butylbenzoxazoyl-(2)]thiophene, thiobismethylbutylphenol, 2-(2'-hydroxy-3'-tert-butyl-5'-methylphenyl)-5-chlorobenzotriazole, 4,4-thiobis(6-tert-butyl-m-cresol), 4,4'-thiobis(6-tert-butyl-m-cresol), 4,4'-dithiomorpholine, triphenyl thiophosphite, trilauryl thiophosphite, triphenyl thiophosphite, N,N'-di-sec-undecyldiaminodiphenyl sulfide, N,N'-di-sec-amyldiaminodiphenyl sulfide, N,N'-di-sec-dodecyldiaminodiphenyl sulfide, N,N'-di-sec-octyldiaminodiphenyl sulfide, N,N'-di-sec-decyldiaminodiphenyl sulfide, N,N'-di-sec-tridecyldiaminodiphenyl sulfide, N,N'-di-sec-nonyldiaminodiphenyl sulfide, N,N'-di-sec-butyldiaminodiphenyl sulfide, N,N'-di-sectetradecyldiaminodiphenyl sulfide, N,N'-di-sec-heptyldiaminodiphenyl sulfide, N,N'-diisopropyldiaminodiphenyl sulfide, N,N'-di-sec-hexyldiaminodiphenyl sulfide, dibenzyl disulfide, 4,4'-thiobis(2-methyl-6-tert-butylphenol), 4,4'-thiobis(3-methyl-6-tert-butylphenol), 4,4'-thiobis(6-tert-butyl-3-methylphenol), diethyl 3,5-di-tert-butyl-4-hydroxybenzylphosphonate, 2-n-octylthio-4,6-di(4'-hydroxy-3',5'-di-tert-butyl)phenoxy-1,3,5-triazine, 2,2'-thiodiethyl bis[3-(3,5-di-tert-butyl-4-hydroxyphenyl) propionate], 2,2'-thiobis(4-methyl-6-tert-butylphenol), 1,3,5-tris(3,5-dibutyl-4-hydroxybenzyl-s-triazine-(1H,3H,5H)-trione, 1,1'-thiobis(2-naphthol), and derivatives of the above compounds.

An organomolybdenum compound, an organozinc compound, or a mixture of these may be further added to the second lubricant composition. This is preferred because the addition thereof is effective in improving load bearing properties and extreme-pressure properties.

As the organomolybdenum compound and organozinc compound, use can be made of conventionally known organomolybdenum compounds and organozinc compounds, besides the organomolybdenum compounds and organozinc compounds usable in the first lubricant composition described above. In particular, dithiocarbamic acid type or dithiophosphoric acid type compounds of molybdenum or zinc can be preferably used.

In the case of adding an organomolybdenum compound and an organozinc compound, the addition amount thereof is preferably such that the total amount of these compounds and the other organometallic compounds is within the preferred range specified hereinabove.

(Third Lubricant Composition)

The third lubricant composition according to the present invention is characterized by containing an organomolybdenum compound and at least one of sulfur compounds which have any of a thiazole group, a thiourea group, a thiocarbamoyl group (thiuram group), an imido group, and a carboxyl group and contain no metal elements (ashless sulfur compounds).

The organomolybdenum compound for use in the third lubricant composition is the same as the organomolybdenum compound for use in the first lubricant composition described above. Especially preferred are the molybdenum dialkyldithiocarbamates represented by the following general formula (V) or the molybdenum dithiophosphates represented by general formula (VI).

(V)

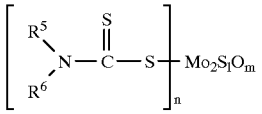

(VI)

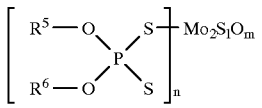

$l + m = 4$

In general formulae (V) and (VI), $R^5$ and $R^6$ have the same meanings as $R^1$ and $R^2$ in general formulae (I) and (II).

The ashless sulfur compound for use in the third lubricant composition is a compound which has any of a thiazole group, thiourea group, thiocarbamoyl group (thiuram group), imido group, and carboxyl group in the basic framework thereof, and is a compound containing no metal elements (ashless compound). Such ashless sulfur compounds are used alone or as a mixture of two or more thereof.

Specific examples thereof include 2,5-dimercapto-1,3,4-thiadiazole, 4-morpholinyl-2-benzothiazole disulfide, N,N'-dicyclohexyl-2-benzothiazolesulfenamide, 2-(4-morpholinyldithio)benzothiazole, 2-mercaptobenzothiazole, 2-benzothiazolyl disulfide, N-tert-butylbenzothiazolesulfonamide, N-oxydiethylene-2-benzothiazolesulfonamide, N-cyclohexyl-2-benzothiazolesulfonamide, 2-benzothiazolyl disulfide, 2-mercaptobenzothiazole sodium salt, 2-(4'-morpholinodithio)benzothiazole, 2-mercaptobenzothiazole, N-cyclohexyl-2-benzothiazolylsulfenamide, N-tert-butyl-2-benzothiazolylsulfenamide, N,N'-dicyclohexyl-2-benzothiazolylsulfenamide, N-tert-butyl-2-benzothiazolesulfenamide, dibenzothiazyl disulfide, pentamethylenedithiocarbamic acid piperazine salt, pentamethylenedithiocarbamic acid piperidine salt, pipecolyldithiocarbamic acid pipecoline salt, 2-mercaptomethylbenzimidazole, 2-mercaptotoluylimidazole zinc salt, 2-mercaptotoluylimidazole, and derivatives of these compounds. Preferred of these are 1,3,4-thiadiazole, derivatives thereof, piperidine pentamethylenedithiocarbamate, and derivatives thereof.

The organomolybdenum compounds enumerated above and the ashless sulfur compounds enumerated above each are added alone or as a mixture of two or more thereof to a lubricant composition. In the case of preparing a mixture to be added, combinations of organomolybdenum compounds and of ashless sulfur compounds are not particularly limited.

The addition amount thereof varies depending on the kind of the lubricant composition, the intended application parts, etc. For example, in the case of a grease for bearings, the addition amount thereof is from 0.3 to 20% by weight, preferably from 0.3 to 12% by weight. If the addition amount thereof is smaller than the lower limit, a sufficient effect is not obtained. Even if the amount thereof is increased beyond the upper limit, not only a further improvement in effect cannot be expected, but there is a possibility that the wear of the lubricated part, e.g., a bearing, proceeds due to a chemical action, etc., resulting in reduced durability of the lubricated part, far from improving durability.

(Fourth Lubricant Composition)

The fourth lubricant composition according to the present invention is characterized by containing at least one organometallic compound wherein the metal is a transition metal or semimetal belonging to the fourth or a later period of the periodic table in the longer form or copper, and further containing a phosphorus compound. The transition metal or semimetal belonging to the fourth or a later period of the longer-form periodic table has the same meaning as the transition metal or semimetal in the first lubricant composition described above. Especially preferred of these are Ni, Sb, Te, Bi, and Se.

Especially preferred organic compounds containing any of these metals (including copper; the same applies hereinafter) and semimetals are the dialkyldithiocarbamic acid compounds and dithiophosphoric acid compounds represented by the following general formulae (VII) and (VIII) wherein M is any of the metals or semimetals, and naphthenic acid compounds and fatty acid compounds of the metals or semimetals.

(VII)

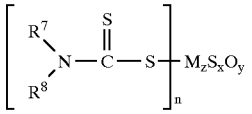

(VIII)

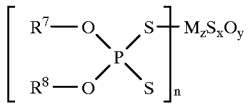

n = 2, 3, 4
x, y, z = 0, 1, 2, 3, 4

In general formulae (VII) and (VIII), $R^7$ and $R^8$ have the same meanings as $R^1$ and $R^2$ in general formulae (I) and (II).

On the other hand, the phosphorus compound for use in the fourth lubricant composition is preferably an orthophosphoric ester represented by the following general formula (IX) or a phosphorous ester represented by general formula (X). Acid esters of these are also usable.

(IX)

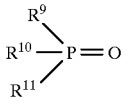

(X)

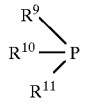

In general formulae (IX) and (X), $R^9$, $R^{10}$, and $R^{11}$ each is a hydrocarbon group or a hydroxy group and may be the same or different.

Specific examples of preferred phosphorus compounds include (2-hydroxyethyl) methacrylate acid phosphate, 2-chloroethyl phosphate, 4,4'-butylidenebis(3-methyl-6-tert-butylphenyl-di-tridecyl) phosphite, 9,10-dihydro-9-oxa-10-phosphaphenanthrene 10-oxide, ethylene glycol phosphate, di-2-ethylhexyl phosphate, diisodecyl pentaerythritol diphosphite, distearyl pentaerythritol diphosphite, ditridecyl pentaerythritol diphosphite, dinonylphenyl pentaerythritol diphosphite, diphenyl isooctyl phosphite, diphenyl isodecyl phosphite, diphenyl decyl phosphite, diphenyl nonylphenyl phosphite, diphenyl hydrogen phosphite, diphenyl mono(tridecyl) phosphite, diphenyl monodecyl phosphite, dilauryl hydrogen phosphite, tetra (tridecyl) 4,4'-isopropylidenediphenyl phosphite, tetraphenyl dipropylene glycol diphosphite, tetraphenyl tetra (tridecyl) pentaerythritol tetraphosphite, tri(2,3-dichloropropyl) phosphite, tri-n-butyl phosphite, triacontenyl phosphite, triisooctyl phosphite, triisodecyl phosphite, trieicosyl phosphite, triethyl phosphite, trioctadecyl phosphite, trioleyl phosphite, tris(2,4-di-tert-butylphenyl) phosphite, tris(2-ethylhexyl) phosphite, tris (tridecyl) phosphite, tris(nonylphenyl) phosphite, trischloroethyl phosphite, trisstearyl phosphite, tridecyl phosphite, tritetracosyl phosphite, tridocosyl phosphite, triphenyl phosphite, trilauryl phosphite, bis(3-methyl-2,6-di-tert-butylphenyl) phosphite, bis[(2-hydroxyethyl) methacrylate]acid phosphite, bisphenol A pentaerythritol phosphite, phenyl diisooctyl phosphite, phenyl diisodecyl phosphite, butyl acid phosphate, butoxyethyl acid phosphate, butoxyethyl acid phosphate diethylamine salt, hexamethylphosphoric triamide, hydrogenated bisphenol A phosphite polymers, monobutyl hydrogen phosphite, dibutyl hydrogen phosphite, monobutyl hydrogen phosphate, dibutyl hydrogen phosphate, monopentyl hydrogen phosphite, dipentyl hydrogen phosphite, monopentyl hydrogen phosphate, dipentyl hydrogen phosphate, monooctyl hydrogen phosphite, dioctyl hydrogen phosphite, dioctyl hydrogen phosphate, monooctyl hydrogen phosphate, dihexadecyl hydrogen phosphite, monohexadecyl hydrogen phosphite, dihexadecyl hydrogen phosphate, monohexadecyl hydrogen phosphate, monolauryl hydrogen phosphite, dilauryl hydrogen phosphate, monolauryl hydrogen phosphate, distearyl hydrogen phosphite, monostearyl hydrogen phosphate, monostearyl hydrogen phosphite, distearyl hydrogen phosphate, dinonyl hydrogen phosphite, monononyl hydrogen phosphite, dinonyl hydrogen phosphate, monononyl hydrogen phosphate, dibutenyl hydrogen phosphate, monobutenyl hydrogen phosphate, dibutenyl hydrogen phosphite, monobutenyl hydrogen phosphite, monooctenyl hydrogen phosphite, dioctenyl hydrogen phosphite, monooctenyl hydrogen phosphate, dioctenyl hydrogen phosphate, monoisobutyl hydrogen phosphate, diisobutyl hydrogen phosphate, monoisobutyl hydrogen phosphite, diisobutyl hydrogen phosphite, monoisopentyl hydrogen phosphite, diisopentyl hydrogen phosphite, monoisopentyl hydrogen phosphate, diisopentyl hydrogen phosphate, monocyclopentyl hydrogen phosphite, dicyclopentyl hydrogen phosphite, monocyclopentyl hydrogen phosphate, dicyclopentyl hydrogen phosphate, monocyclohexyl hydrogen phosphite, dicyclohexyl hydrogen phosphite, monocyclohexyl hydrogen phosphate, dicyclohexyl hydrogen phosphate, monobenzyl hydrogen phosphite, dibenzyl hydrogen phosphite, monobenzyl hydrogen phosphate, dibenzyl hydrogen phosphate, monophenyl hydrogen phosphite, diphenyl hydrogen phosphate, monophenyl hydrogen phosphate, monotoluyl hydrogen phosphite, ditoluyl hydrogen phosphite, monotoluyl hydrogen phosphate, ditoluyl hydrogen phosphate, mono-2-ethylhexyl hydrogen phosphite, di-2-ethylhexyl hydrogen phosphite, mono-2-ethylhexyl hydrogen phosphate, di-2-ethylhexyl hydrogen phosphate, mono-2-methylhexyl hydrogen phosphate, di-2-methylhexyl hydrogen phosphate, mono-2-methylhexyl hydrogen phosphite, di-2-methylhexyl hydrogen phosphite, mono-2-propylhexyl hydrogen phosphite, di-2-propylhexyl hydrogen phosphite, mono-2-propylhexyl hydrogen phosphate, di-2-propylhexyl hydrogen phosphate, monooleyl hydrogen phosphite, dioleyl hydrogen phosphite, monooleyl hydrogen phosphate, dioleyl hydrogen phosphate, mono-tert-butyl hydrogen phosphate, di-tert-butyl hydrogen phosphate, mono-tert-butyl hydrogen phosphite, di-tert-butyl hydrogen phosphite, di-2-methylpropyl hydrogen phosphite, mono-2-methylpropyl hydrogen phosphite, di-2-methylpropyl hydrogen phosphate, mono-2-methylpropyl hydrogen phosphate, di-2-ethylpropyl hydrogen phosphite, mono-2-ethylpropyl hydrogen phosphite, di-2-ethylpropyl hydrogen phosphate, mono-2-ethylpropyl hydrogen phosphate, di-2-ethylbutyl hydrogen phosphite, mono-2-ethylbutyl hydrogen phosphite, di-2-ethylbutyl hydrogen phosphate, mono-2-ethylbutyl hydrogen phosphate, di-2-ethyllauryl hydrogen phosphite, mono-2-ethyllauryl hydrogen phosphite, di-2-ethyllauryl hydrogen phosphate, mono-2-ethyllaryl hydrogen phosphate, monododecyl hydrogen phosphite, didodecyl hydrogen phosphite, monododecyl hydrogen phosphate, didodecyl hydrogen phosphate, di-2-methylstearyl hydrogen phosphite, mono-2-methylstearyl hydrogen phosphite, di-2-methylstearyl hydrogen phosphate, mono-2-methylstearyl hydrogen phosphate, monoisodecyl phosphate, tributyl phosphite, tributyl phosphate, tripentyl phosphite, tripentyl phosphate, trioctyl phosphate, trioctyl phosphite, trihexadecyl phosphite, trihexadecyl phosphate, trilauryl phosphate, tristearyl phosphate, trinonyl phosphite, trinonyl phosphate, tributenyl phosphate, tributenyl phosphite, trioctenyl phosphite, trioctenyl phosphate, triisobutyl phosphite, triisobutyl phosphate, triisopentyl phosphate, triisopentyl phosphite, tricyclopentyl phosphate, tricyclopentyl phosphite, tricyclohexyl phosphite, tricyclohexyl phosphate, tribenzyl phosphite, tribenzyl phosphate, triphenyl phosphate, tritoluyl phosphite, tritoluyl phosphate, tris(2-ethylhexyl) phosphate, tris(2-methylhexyl) phosphite, tris (2-methylhexyl) phosphate, tris(2-propylhexyl) phosphite, tris(2-propylhexyl) phosphate, trioleyl phosphate, tris(tert-butyl) phosphite, tris(tert-butyl) phosphate, tris(2-methylpropyl) phosphite, tris(2-ethylpropyl) phosphate, tris (2-ethylbutyl) phosphate, tris(2-ethylbutyl) phosphite, tris (2-ethyllauryl) phosphite, tris(2-ethyllauryl) phosphate, tridodecyl phosphite, tridodecyl phosphate, tris(2-methylstearyl) phosphite, tris(2-methylstearyl) phosphate, tris(nonylphenyl) phosphate, and derivatives of these compounds.

Among these phosphorus compounds, preferred are those which contain an alkylene glycol in the structure or those which have an alkyl chain at the terminal(s) of the structure. In the case of the phosphorus compounds containing an alkylene glycol, the glycol is especially preferably ethylene glycol or propylene glycol. In the case of the phosphorus compounds having an alkyl chain at the terminal(s) of the structure, the alkyl is especially preferably a $C_2$ to $C_{18}$ chain.

Examples of such especially preferred phosphorus compounds include trioctyl phosphate, monoisodecyl phosphate, trinonylphenyl phosphite, dilauryl hydrogen phosphite, diphenyl monodecyl phosphite, tetraphenyl dipropyl glycol diphosphite, tetraphenyl tetra(tridecyl) pentaerythritol tetraphosphite, and tetra(tridecyl) 4,4'-isopropylidenediphenyl diphosphite.

The organometallic or organosemimetallic compounds enumerated above and the phosphorus compounds enumerated above each are added alone or as a mixture of two or more thereof to a lubricant composition. In the case of preparing a mixture to be added, combinations of organometallic or organosemimetallic compounds and of phosphorus compounds are not particularly limited.

The addition amount thereof varies depending on the kind of the lubricant composition, the intended application parts, etc. For example, in the case of a grease for bearings, the addition amount thereof is from 0.3 to 20% by weight, preferably from 0.3 to 12% by weight. If the addition amount thereof is smaller than the lower limit, a sufficient effect is not obtained. Even if the amount thereof is increased beyond the upper limit, not only a further improvement in effect cannot be expected, but there is a possibility that the wear of the lubricated part, e.g., a bearing, proceeds due to a chemical action, etc., resulting in reduced durability of the lubricated part, far from improving durability.

A combination of any of the aforementioned organometallic or organosemimetallic compounds and any of the aforementioned phosphorus compounds can be used together with conventionally known organomolybdenum and organozinc compounds. Especially preferably used are dithiocarbamic acid compounds and dithiophosphoric acid compounds of molybdenum or zinc. The use thereof is effective in further improving load bearing properties and extreme-pressure properties.

(Fifth Lubricant Composition)

The fifth lubricant composition according to the present invention is characterized by containing an organonickel compound.

Preferred examples of the organonickel compound include nickel dithiocarbamates, nickel dithiophosphate, nickel naphthenates, nickel carboxylates, and nickel alkoxides. Especially preferably used are nickel dithiocarbamates.

The above compounds each may have one or more substituents. Especially preferred nickel dithiocarbamates are represented by the following general formula (XI).

(XI)

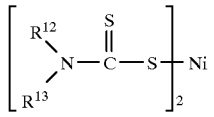

In general formula (XI), $R^{12}$ and $R^{13}$ each is an alkyl group or an aryl group and may be the same or different. In particular, nickel dialkyldithiocarbamates in which the alkyl groups each has 1 to 18 carbon atoms are preferred.

The fifth lubricant composition per se has load bearing properties and extreme-pressure properties, but this lubricant composition preferably further contains at least one of dithiophosphoric acid type zinc compounds and dithiophosphoric acid type molybdenum compounds. In particular, the fifth lubricant composition further containing both a dithiophosphoric acid type zinc compound and a dithiophosphoric acid type molybdenum compound is the most effective.

Preferred examples of the dithiophosphoric acid type zinc compound (ZnDTP) include zinc diaryldithiophosphates, zinc alkylaryldithiophosphates, and zinc dialkyldithiophosphates. Preferred examples of the dithiophosphoric acid type molybdenum compound (MoDTP) include molybdenum dialkyldithiophosphates, molybdenum alkylaryldithiophosphates, and molybdenum diaryldithiophosphates.

Especially preferably used MoDTP's and ZnDTP's are represented by general formulae (XIII) and (IVX), respectively.

(XIII)

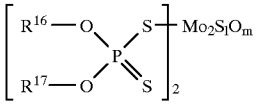

(IVX)

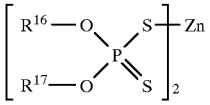

$(l + m) = 4$

In the above general formulae, $R^{16}$ and $R^{17}$ each is an alkyl group or an aryl group and may be the same or different.

The content of the organonickel compound varies depending on the kind of the lubricant composition, the intended application parts, etc., and on whether the organonickel compound is used singly or in combination with an MoDTP and a ZnDTP. For example, in the case of a grease for bearings, the content thereof is preferably higher than 2% by weight based on the total amount of the lubricant composition when the organonickel compound is used singly. On the other hand, when the organonickel compound is used in combination with an MoDTP and a ZnDTP, the content thereof is 1% by weight or higher. Although the upper limit of the content thereof is 20% by weight in either case, it is preferably 15% by weight from the standpoint of the amount thereof relative to that of the base oil. In the case of using a combination of these compounds, the mixing ratio thereof is not particularly limited.

(Sixth Lubricant Composition)

The sixth lubricant composition according to the present invention is characterized by containing at least one organometallic compound wherein the metal is selected from tellurium, selenium, copper, and iron.

The organic moiety may be one derived from any of sulfonic acid, fatty acid, naphthenic acid, benzothiazole, acrylate, dithiophosphoric acid, and dithiocarbamic acid compounds and the like. However, the dithiocarbamic acid type organometallic compounds represented by the following general formula (XII) are especially preferred.

(XII)

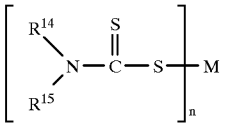

n = 2, 3, 4

In the above general formula, M is any one of Te, Se, Cu, and Fe. $R^{14}$ and $R^{15}$ each is an alkyl group or an aryl group and may be the same or different.

The sixth lubricant composition per se has load bearing properties and extreme-pressure properties, but this lubricant composition preferably further contains an MoDTP and/or a ZnDTP usable in the fifth lubricant composition described above. In particular, the sixth lubricant composition further containing both an MoDTP and a ZnDTP is the most effective.

One or combinaiton of two or more of the organometallic compounds is used, and the content thereof is desirably from 1 to 20% by weight based on the total amount of the lubricant composition. The content thereof is preferably from 2 to 12% by weight. If the content thereof is smaller than the lower limit, a sufficient effect is not obtained. Even if the content thereof is increased beyond the upper limit, not only a further improvement in effect cannot be expected, but there is a possibility that the wear of the lubricated part proceeds due to a chemical action, resulting in reduced durability of the lubricated part, far from improving durability. In the case of using a combination of those compounds, the mixing ratio thereof is not particularly limited.

The specific organometallic compounds in the lubricant compositions of the present invention described above are thought to function to prevent rolling surfaces and rolling/sliding surfaces from coming into contact with a metal, but the mechanism has not been elucidated. It is however thought that if a rolling surface or rolling/sliding surface in the state of boundary lubrication comes into contact with a metal, the compounds decompose due to the heat generated on the contact surface to form a protective film on the metal surface which generated heat. The resulting protective film is thought to produce the effects of enhancing the load bearing properties of the rolling/sliding surface and inhibiting heat generation.

The lubricant compositions of the present invention can be used as a lubricating oil for various mechanical parts, e.g., an engine oil or gear oil. Furthermore, since the lubricant compositions are excellent in load bearing properties and extreme-pressure properties, they are especially suitable for use as a grease packed into various bearings to be placed under a high load and used at a high temperature and high rotational speed.

Preferred embodiments as a grease are explained below.

Base oils usable for preparing a grease include mineral oils, synthetic oils, and a mixture of these oils, which are usually used for a grease. Specifically, examples of the mineral oils include paraffinic mineral oils and naphthenic mineral oils. Examples of synthetic hydrocarbon oils include poly-α-olefin oils. Examples of ether oils include dialkyl diphenyl ether oils, alkyl triphenyl ether oils, and alkyl tetraphenyl ether oils. Examples of ester oils include diester oils, polyol ester oils or complex ester oils thereof, and aromatic ester oils.

It is preferred that the base oil contains synthetic oils, in particular, ester oils and ether oils, from the standpoints of lubricating performance and lubricity life at high temperatures and high speeds.

Thickeners also are not particularly limited. For example, use may be suitably made of metal soaps such as soaps of aluminum, barium, calcium, lithium, and sodium, complex metal soaps such as lithium complex soaps, calcium complex soaps, and aluminum complex soaps, urea compounds such as diurea, triurea, tetraurea, and polyureas, inorganic compounds such as silica gel and bentonite, urethane compounds, urea-urethane compounds, and sodium terephthalamate compounds.

Use of a urea compound having excellent oxidative stability is effective in further improving lubricating performance and lubricity life in high-speed rotation at high temperatures.

The compounded amount of a thickener is usually from 5 to 35% by weight.

The following conventionally known additives can be incorporated into the grease. Further, solid lubricants such as molybdenum disulfide and graphite may be added.

[Antioxidant]

Antioxidants suitably selected from aging inhibitors, ozone deterioration inhibitors, and antioxidants for rubbers, plastics, lubricating oils, etc. may be used. For example, the following compounds can be used.

Examples of usable antioxidants include amine compounds such as phenyl-1-naphthylamine, phenyl-2-naphthylamine, diphenyl-p-phenylenediamine, dipyridylamine, phenothiazine, N-methylphenothiazine, N-ethylphenothiazine, 3,7-dioctylphenothiazine, p,p'-dioctyldiphenylamine, N,N'-diisopropyl-p-phenylenediamine, and N,N'-di-sec-butyl-p-phenylenediamine and phenolic compounds such as 2,6-di-tert-dibutylphenol.

[Rust Preventive/Metal Deactivator]

The following compounds can, for example, be used as rust preventives.

Examples of usable rust preventives include ammonium salts of organic sulfonic acids, organic sulfonic acid salts of alkali or alkaline earth metals such as barium, zinc, calcium, and magnesium, organic carboxylic acid salts, phenates, phosphonates, alkyl- or alkenylsuccinic acid derivatives such as alkyl- or alkenylsuccinic esters, partial esters of polyhydric alcohols such as sorbitan monooleate, hydroxyfatty acids such as oleoylsarcosine, mercaptofatty acids or metal salts thereof such as 1-mercaptostearic acid, higher fatty acids such as stearic acid, higher alcohols such as isostearyl alcohol, esters of higher alcohols with higher fatty acids, thiazoles such as 2,5-dimercapto-1,3,4-thiadiazole and 2-mercaptothiadiazole, imidazole compounds such as 2-(decyldithio)benzimidazole and benzimidazole, disulfide compounds such as 2,5-bis(dodecyldithio)benzimidazole, phosphoric esters such as trisnonylphenyl phosphite, and thiocarboxylic ester compounds such as dilauryl thiopropionate.

Nitrous acid salts and the like are also usable.

As the metal deactivator, triazole compounds such as benzotriazole and tolyltriazole can be used.

[Oiliness Improver]

For instance, the following compounds can be used as an oiliness improver.

Examples of the useful oiliness improver include fatty acids such as oleic acid and stearic acid, aliphatic alcohols such as oleyl alcohol, fatty acid esters such as polyoxyethylene stearate and polyglyceryl oleate, phosphoric acid, and phosphoric esters such as tricresyl phosphate, lauryl ester, and polyoxyethylene oleyl ether phosphate.

The lubricant compositions of the present invention will be explained below in more detail by means of Examples of greases and Comparative Examples.

EXAMPLES OF THE FIRST TO FOURTH LUBRICANT COMPOSITIONS

The greases used in the Examples and the Comparative Examples are the urea grease and lithium grease prepared in the following ways.

Urea grease: A grease comprising a mineral oil having a kinematic viscosity at 40° C. of 150 cSt as a base oil and a diurea compound produced by reacting 4,4'-diphenylmethane diisocyanate with octylamine as a thickener.

Lithium Grease: A grease comprising a mineral oil having a kinematic viscosity at 40° C. of 150 cSt as a base oil and a lithium stearate as a thickener.

The thickeners each was used in such an amount that the final content thereof in the grease was 10% by weight.

The compounds shown in Tables 1 to 10 were added to the above greases according to formulations for the first to fourth lubricant compositions of the present invention to prepare test greases, which were subjected to a seizure test and a bearing durability test. The seizure test was conducted with respect to all test greases, while the bearing durability test was conducted with respect to representative ones only.

The test methods are as follows.

1. Seizure Test

This seizure test is a test for the evaluation of the extreme-pressure properties of a lubricant composition (in this case, a grease), and was conducted by the four-ball test method using the test apparatus provided for in ASTM as follows. Three test balls (steel balls for ball bearing use, SUJ2 ½") were fixed in such positions that they formed an equilateral triangle while in contact with one another, and one test ball was placed on the depression formed at the center thereof. The spaces among the test balls were filled with a test grease. While the test ball placed on top was kept being rotated at a constant rotational speed (4,000 rpm), a load of 6 kgf was imposed thereon for the initial 1 minute and then the load was gradually increased at a rate of 50 kgf/min. The load imposed at the time when the rotational torque increased abruptly was determined as the seizure load.

According to the evaluation criteria used, the greases with which the seizure load was 60 kgf or higher were regarded as acceptable.

2. Bearing Durability Test

This bearing durability test is a test for the evaluation of the high-temperature durability of a lubricant composition (in this case, a grease), and was conducted by the following method. A rolling bearing (designation: HR30205J) was filled with 3 g of each test grease, and the shaft was rotated at a high rotational speed of 10,000 rpm under the conditions of a temperature of 120° C., a radial load of 50 kgf, and an axial load of 150 kgf. The time period required for the bearing to seize was measured.

According to the evaluation criteria used, the greases use of which under the above conditions resulted in 1,000 hours or longer were regarded as acceptable.

The results of the above-described seizure test and bearing durability test are given in Tables 1 to 10.

TABLE 1

| | First Lubricant Composition | | | | | |
|---|---|---|---|---|---|---|
| Example | 1 | 2 | 3 | 4 | 5 | 6 |
| Grease | urea | urea | urea | urea | urea | urea |
| Organoantimony compound | antimony dialkyl-dithiocarbamate 2 | | antimony dialkyl-dithiocarbamate 2 | antimony dialkyldithio-carbamate 2 | antimony dialkyl-dithiocarbamate 2 | |
| Organotin compound | | dibutyltin maleate 2 | | | | dibutyltin maleate 2 |
| Organotellurium compound | tellurium diethyldithio-carbamate 2 | tellurium diethyldithio-carbamate 2 | tellurium diethyldithio-carbamate 2 | | | |
| Organonickel compound | | | | nickel dibutyl-dithiocarbamate 2 | nickel dibutyldithio-carbamate 2 | nickel dibutyl-dithiocarbamate 2 |
| Organozinc compound | | | zinc dialkyldithio-phosphate 1 | | zinc dialkyldithio-phosphate 1 | |
| Seizure load (kgf) | 80 | 110 | 85 | 65 | 75 | 95 |
| Durability time (h) | — | 1290 | — | — | — | — |

TABLE 2

| | First Lubricant Composition | | |
|---|---|---|---|
| Comparative Example | 1 | 2 | 3 |
| Grease | urea | lithium | urea |
| Organoantimony compound | antimony dialkyldithiocarbamate 4 | | |
| Organomolybdenum compound | | molybdenum dialkyldithiocarbamate 4 | |
| Organotin compound | | | dibutyltin maleate 4 |
| Seizure load (kgf) | 45 | 45 | 50 |
| Durability time (h) | 650 | — | — |

TABLE 3

| | Second Lubricant Composition | | | | | | |
|---|---|---|---|---|---|---|---|
| Example | 1 | 2 | 3 | 4 | 5 | 6 | 7 |
| Grease | urea | urea | urea | urea | urea | urea | urea |
| Sulfur compound | piperidine pentamethylenedithiocarbamate 2 | piperidine pentamethylenedithiocarbamate 1.5 | piperidine pentamethylenedithiocarbamate 1.5 | piperidine pentamethylenedithiocarbamate 1.5 | piperidine pentamethylenedithiocarbamate 2 | piperidine pentamethylenedithiocarbamate 2 | piperidine pentamethylenedithiocarbamate 2 |
| Organotellurium compound | tellurium diethyldithiocarbamate 2 | tellurium diethyldithiocarbamate 1.5 | | | | | |
| Organonickel compound | | | | | nickel diethyldithiocarbamate 1.5 | | |
| Organoselenium compound | | | | | | selenium diethyldithiocarbamate 2 | |
| Organoantimony compound | | | antimony dialkyldithiocarbamate 1.5 | antimony dialkyldithiocarbamate 1.5 | | | |
| Organomolybdenum compound | | | molybdenum dialkyldithio carbamate 0.5 | molybdenum dialkyldithio phosphate 1 | | | antimony dialkyldithiocarbamate 2 |
| Organozinc compound | | zinc dialkyldithiophosphate 1 | zinc dialkyldithiophosphate 0.5 | | | | |
| Seizure load (kgf) | 80 | 85 | 75 | 70 | 75 | 70 | 65 |
| Durability time (h) | 1200 | — | 1320 | — | — | — | — |

TABLE 4

| Second Lubricant Composition | | | | | | |
|---|---|---|---|---|---|---|
| Example | 8 | 9 | 10 | 11 | 12 | 13 |
| Grease | lithium | lithium | urea | urea | urea | urea |
| Sulfur compound | dibenzothiazyl disulfide 2 | N,N'-diphenyl-thiourea 2 | tetrabutyl-thiuram disulfide 2 | N-cyclohexyl-thiophthalimide 2 | 2-(4'-morpho-linodithio)-benzothiazole 2 | dilauryl 3,3'-thiopropionate 2 |
| Organotellurium compound | | tellurium diethyldithio-carbamate 2 | tellurium diethyldithio-carbamate 2 | | tellurium diethyldithio-carbamate 2 | tellurium diethyldithio-carbamate 2 |
| Organonickel compound | nickel diethyldi-thiocarbamate 2 | | | nickel diethyldi-thiocarbamate 2 | | |
| Organoselenium compound | | | | | | |
| Organoantimony compound | | | | | | |
| Organo-molybdenum compound | | | | | | |
| Organozinc compound | | | | | | |
| Seizure load (kgf) | 85 | 70 | 70 | 80 | 80 | 85 |
| Durability time (h) | — | — | — | 1300 | — | — |

TABLE 5

| Second Lubricant Composition | | | |
|---|---|---|---|
| Comparative Example | 1 | 2 | 3 |
| Grease | urea | urea | lithium |
| Additive 1 | molybdenum dialkyl-dithio-carbamate 2 | molybdenum dialkyl-dithiocarbamate 2 | molybdenum dialkyl-dithio-carbamate 2 |
| Additive 2 | zinc dialkyl-dithio-phosphate 1 | piperidine penta-methylenedithio-carbamate 2 | dialkyldithio-carbamic acid 2 |

TABLE 5-continued

| Second Lubricant Composition | | | |
|---|---|---|---|
| Comparative Example | 1 | 2 | 3 |
| Additive 3 | molybdenum dialkyl-dithio-phosphate 1 | | |
| Seizure load (kgf) | 55 | 50 | 45 |
| Durability time (h) | 700 | 800 | — |

TABLE 6

| Third Lubricant Composition | | | | | | |
|---|---|---|---|---|---|---|
| Example | 1 | 2 | 3 | 4 | 5 | 6 |
| Grease | urea | urea | urea | urea | urea | urea |
| Organo-molybdenum compound | molybdenum dialkyldithio-carbamate 2 | molybdenum dialkyldithio-carbamate 2 | molybdenum dialkyldithio-carbamate 2 | molybdenum dialkyldithio-carbamate 2 | molybdenum dialkyldithio-carbamate 2 | molybdenum dialkyldithio-phosphate 2 |
| Sulfur compound | N-cyclohexyl phthalimide 2 | 1,3,4-thiadiazole 2 | 2-(4'-morpholino-dithio)benzo-thiazole 2 | 2-mercaptobenzo-thiazole 2 | N,N'-diphenyl-thiourea 2 | dilauryl 3,3'-thiopropionate 2 |

TABLE 6-continued

| Third Lubricant Composition | | | | | | |
|---|---|---|---|---|---|---|
| Seizure load (kgf) | 120 | 90 | 80 | 65 | 90 | 70 |
| Durability time (h) | 1070 | 1140 | — | — | — | — |

| Comparative Example | 1 | 2 | 3 |
|---|---|---|---|
| Grease | urea | urea | urea |
| Additive 1 | methylenebis(dibutyl)dithio-carbamate 2 | methylenebis(dibutyl)dithio-carbamate 4 | sulfurized olefin 2 |
| Additive 2 | molybdenum dialkyldithio-carbamate 2 | | molybdenum dialkyldithio-carbamate 2 |
| Seizure load (kgf) | 55 | 45 | 50 |
| Durability time (h) | 830 | — | — |

TABLE 7

| Fourth Lubricant Composition | | | | | | | |
|---|---|---|---|---|---|---|---|
| Example | 1 | 2 | 3 | 4 | 5 | 6 | 7 |
| Grease | urea | urea | urea | urea | urea | urea | urea |
| Phosphoric ester | didodecyl hydrogen phosphite 2 | didodecyl-hydrogen phosphite 2 | diphenyl monodecyl phosphite | diphenyl monodecyl phosphite 1.5 | tetraphenyl dipropylene glycol diphosphite 2 | tetraphenyl dipropylene glycol diphosphite 2 | tetraphenyl dipropylene glycol diphosphite 2 |
| Organo-tellurium compound | | tellurium diethyldithio-carbamate 2 | | tellurium diethydithio-carbamate 1.5 | | | tellurium diethyldithio-carbamate 2 |
| Organonickel compound | nickel dibutyldithio-carbamate 2 | | nickel dibutyldithio-carbamate 2 | | nickel dibutyldithio-carbamate 2 | | |
| Organoselenium compound | | | | | | | |
| Organoantimony compound | | | | | | antimony dialkyldithio-carbamate 2 | |
| Organo-molybdenum compound | | | | molybdenum dialkyldithio-phosphate 1 | | | |
| Organozinc compound | | | | | | | |
| Seizure load (kgf) | 98 | 85 | 65 | 75 | 65 | 130 | 140 |
| Durability time (h) | — | — | — | 1550 | — | — | 1820 |

TABLE 8

| Fourth Lubricant Composition | | | | | | | |
|---|---|---|---|---|---|---|---|
| Example | 8 | 9 | 10 | 11 | 12 | 13 | 14 |
| Grease | urea | urea | urea | lithium | urea | urea | urea |
| Phosphoric ester | tetra(tri-decyl)4,4'-iso- | tetra(tri-decyl)4,4'-iso- | tetra(tri-decyl)4,4'-iso- | trioctyl phosphate 2 | trioctyl phosphate 2 | trioctyl phosphate 2 | trioctyl phosphate 2 |

TABLE 8-continued

| | Fourth Lubricant Composition | | | | | | |
|---|---|---|---|---|---|---|---|
| Example | 8 | 9 | 10 | 11 | 12 | 13 | 14 |
| | propylidene-diphenyl diphosphite 2 | propylidene-diphenyl diphosphite 2 | propylidene-diphenyl diphosphite 1.5 | | | | |
| Organo-tellurium compound | | tellurium di-ethyldithio-carbamate 2 | | | tellurium di-ethyldithio-carbamate 2 | | |
| Organonickel compound | nickel dibutyldithio-carbamate 2 | | nickel dibutyldithio-carbamate 1.5 | | | | |
| Organoselenium compound | | | | | | | selenium di-ethyldithio-carbamate 2 |
| Organoantimony compound | | | | antimony dialkyldithio-carbamate 2 | | antimony dialkyldithio-carbamate 1 | |
| Organo-molybdenum compound | | | | | | molybdenum dialkyldithio-phosphate 1 | |
| Organozine compound | | | zinc dialkyldi-thiophosphate 1 | | | | |
| Seizure load (kgf) | 65 | 120 | 85 | 90 | 110 | 100 | 65 |
| Durability time (h) | — | — | — | — | — | — | — |

TABLE 9

| | Fourth Lubricant Composition | | | | | | |
|---|---|---|---|---|---|---|---|
| Example | 15 | 16 | 17 | 18 | 19 | 20 | 21 |
| Grease Phosphoric ester | urea trisnonylphenyl phosphite 2 | urea trisnonylphenyl phosphite 2 | urea trisnonylphenyl phosphite 2 | urea trisnonylphenyl phosphite 1 | urea dilauryl hydrogen phosphite 2 | urea monodecyl phosphate 2 | urea tetraphenyl tetra(tri-decyl)penta-erythritol tetraphosphite 2 |
| Organo-tellurium compound | | | | | | | |
| Organonickel compound | nickel dibutyldithio-carbamate 2 | | | | | nickel dibutyldithio-carbamate 2 | nickel dibutyldithio carbamate 2 |
| Organoselenium compound | | | selenium diethyldithio-carbamate 2 | selenium diethyldithio-carbamate 1 | | | |
| Organoantimony compound | | antimony dialkyldithio-carbamate 2 | | | antimony dialkyldithio-carbamate 2 | | |
| Organo-molybdenum compound | | | | molybdenum dialkyldithio-phosphate 1 | | | |
| Organozinc compound | | | | zinc dialkyldi-thiophosphate 1 | | | |

TABLE 9-continued

| Fourth Lubricant Composition | | | | | | | |
|---|---|---|---|---|---|---|---|
| Example | 15 | 16 | 17 | 18 | 19 | 20 | 21 |
| Seizure load (kgf) | 70 | 85 | 85 | 100 | 100 | 90 | 65 |
| Durability time (h) | — | — | — | — | — | — | — |

TABLE 10

| Fourth Lubricant Composition | | | | | |
|---|---|---|---|---|---|
| Comparative Example | 1 | 2 | 3 | 4 | 5 |
| Grease | | | | | |
| Phosphoric ester | urea dilauryl hydrogen phosphate 4 | urea trioctyl phosphate 4 | lithium tetra (tridecyl) 4,4'-isopropylidene-diphenyl diphosphite 2 | urea tetra (tridecyl) 4,4'-isopropylidene-diphenyl diphosphite 2 | urea diphenyl mono-decyl phosphate 1 |
| Additive 2 | | | molybdenum dialkyldithiocarbamate 2 | molybdenum dialkyldithiocarbamate 2 | molybdenum dialkyldithiocarbamate 1 |
| Additive 3 | | | | | molybenum dialkyldithiophosphate 1 |
| Additive 4 | | | | | zinc dialkyldithiophosphate 1 |
| Seizure load (kgf) | 55 | 50 | 50 | 45 | 50 |
| Durability time (h) | — | 800 | — | — | 920 |

Tables 1 and 2 summarize Examples and Comparative Examples of the first lubricant composition; Tables 3 to 5 summarize Examples and Comparative Examples of the second lubricant composition; Table 6 summarizes Examples and Comparative Examples of the third lubricant composition; and Tables 7 to 10 summarize Examples and Comparative Examples of the fourth lubricant composition.

Each Table shows that the greases of the Examples were superior in both seizure load and durability time to the greases of the Comparative Examples.

EXAMPLES OF THE FIFTH LUBRICANT COMPOSITION

Test 1

Test greases were prepared using the base oils, thickeners, organonickel compound, rust preventive, and antioxidants shown in Tables 11 and 12. For the purpose of comparison, commercial greases for high-temperature use were also used.

A rolling bearing (designation: 6305VVC3E) was filled with 3 g of each test grease, and the shaft was rotated at a high rotational speed of 10,000 rpm under the conditions of a temperature of 170° C., a radial load of 10 kgf, and an axial load of 100 kgf. The time period required for the bearing to seize was measured. The results of the measurement are given in Tables 11 and 12.

TABLE 11

| Fifth Lubricant Composition | | | | | |
|---|---|---|---|---|---|
| Example | 1 | 2 | 3 | 4 | 5 |
| Thickener | lithium complex | lithium complex | lithium soap | diurea (alicyclic) | diurea (alicyclic) |
| Base oil | ether oil + ester oil | mineral oil | ether oil | ether oil | ether oil + synthetic hydrocarbon oil |
| Viscosity of base oil, 40° C., $mm^2/s$ | 80 | 250 | 97 | 97 | 120 |
| Organonickel | nickel dibutyldithiocarbamate | nickel dibutyldithiocarbamate | nickel diethyldithiocarbamate | nickel-diethyldithiocarbamate | nickel diethyldithiocarbamate |
| Amount (wt %) | 3 | 10 | 12 | 0.3 | 2 |
| Rust preventive | barium sulfonate | barium sulfonate | barium sulfonate | barium sulfonate | barium sulfonate |
| Amount (wt %) | 1 | 1 | 1 | 1 | 1 |
| Antioxidant | phenyl-1-naphthylamine | phenyl-1-naphthylamine | phenyl-1-naphthylamine | none | none |
| Amount (wt %) | 2 | 2 | 2 | | |
| Seizure time (h) | 900 | 420 | 500 | 800 | 1000 |

TABLE 12

| Fifth Lubricant Composition | | | | | |
|---|---|---|---|---|---|
| Comparative Example | 1 | 2 | 3 | 4 | 5 |
| Thickener | diurea (alicyclic) | diurea (alicyclic) | diurea (aliphatic) | commercial grease for high temp. (urea) | commercial grease for high temp. (urea) |
| Base oil | synthetic hydrocarbon oil | ether oil + synthetic hydrocarbon oil | mineral oil | ether oil | ester oil |
| Viscosity of base oil, 40° C., $mm^2/s$ | 80 | 120 | 250 | 150 | 65 |
| Organonickel | none | none | none | none | none |
| Amount (wt %) | | | | | |
| Rust preventive | barium sulfonate | barium sulfonate | barium sulfonate | | |

TABLE 12-continued

| | Fifth Lubricant Composition | | | | |
|---|---|---|---|---|---|
| Comparative Example | 1 | 2 | 3 | 4 | 5 |
| Amount (wt %) | 1 | 1 | 1 | | |
| Antioxidant | dioctyldi-phenyl-amine 2 | high-molecular phenol 2 | dioctyldi-phenyl-amine 2 | | |
| Amount (wt %) | | | | | |
| Seizure time (h) | 120 | 200 | 150 | 300 | 280 |

Tables 11 and 12 show that the greases of the Examples according to the present invention had far longer seizure lives than the greases of the Comparative Examples and the commercial greases for high-temperature use, irrespective of the kinds of the base oils and thickeners and the combinations of these. The tables further show that even the greases containing no antioxidant (Examples 4 and 5) had an excellent antiseizing performance.

Test 2

[Production of Greases]

Experimental Production of Base Greases:

Greases having the compositions shown below were produced as shown in Table 13, and used as base greases.

(1) Base Grease for Examples 1 to 4 and 6 and Comparative Examples 1 and 2:

Thicker: diurea compound

Amount of thickener: 30% by weight

Base oil: mineral oil (138 $mm^2$/sec, 40° C.)

(2) Base Grease for Example 5:

Thicker: lithium 12-hydroxystearate

Amount of thickener: 25% by weight

Base oil: mineral oil (138 $mm^2$/sec, 40° C. )

Production of Grease Compositions to be Subjected to Examples and Comparative Examples:

An amine type antioxidant (PANA) was added in an amount of 2% by weight based on the total grease composition amount together with an M-DTC, an MoDTP, and a ZnDTP in the amounts shown in Table 13 to prepare additive-containing mineral oils. The additive-containing mineral oils were added to the above base greases in such an amount that the content of the thickener was 10% by weight, and the resulting mixtures were stirred until they became homogeneous. This stirring may be conducted with heating at 80 to 130° C. for several tens of minutes (under temperature and time conditions which do not result in base oil deterioration) in order to enhance homogeneity. Thereafter, each mixture was treated with a three-roll mill from one to three times to homogenize the same.Thus, grease compositions were obtained.

For the purpose of comparison, a commercial grease containing a sulfur-phosphorus compound extreme-pressure additive was used (Comparative Example 3).

In the table, the symbol of element in each metal-DTC indicates the metal forming the salt with DTC. A chemical formula of the molybdenum dialkyldithiocarbamate (MoDTC) used in Comparative Examples is shown below. In the formula, $R^{18}$ and $R^{19}$ each is an alkyl group or an aryl group, and (l+m) is 4.

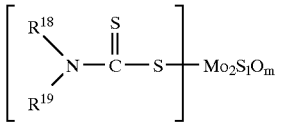

The grease compositions thus obtained each had a worked penetration in the range of from No. 2 to No. 1.

[Evaluation of Lubricating Properties]

The grease compositions were evaluated for the effect of inhibiting heat generation through the measurement of the bearing temperature and for load bearing property through a four-ball test.

Effect of Inhibiting Heat Generation

Measurement of bearing temperature with tapered roller bearing rotary tester (Test Conditions)

Test bearing: normally tapered roller bearing having an inner diameter of ϕ25 and an outer diameter of ϕ52

Load: radial 50 kgf, axial 50 kgf

Rotational speed: 10,000 rpm

Atmospheric temperature: room temperature (Evaluation)

The temperature of the outer ring of the bearing was measured after 24-hour under the test conditions described above.

(Criteria for Judgment)

Increase in Temperature of Bearing

| | |
|---|---|
| 60° C. or more . . . no effect | "D" |
| 50° C. to less than 60° C. . . . insufficient effect | "C" |
| 40° C. to less than 50° C. . . . effective | "B" |
| below 40° C. . . . excellent effect | "A" |

Load Bearing Property

Four-ball tester (with respect to details of the test method, see the Examples of the first to fourth lubricant compositions)

(Test Conditions)

Balls: ¾" steel balls made of SUJ2

Rotational speed: constant speed of 4,000 rpm

Load: continuous load of 70 kgf/min (Evaluation)

The load imposed at the time when the torque began to increase abruptly was taken as the seizure load.

(Criteria for Judgment)

Seizure load

| | |
|---|---|
| below 30 kgf . . . no effect | "D" |
| 30 kgf to less than 50 kgf . . . insufficient effect | "C" |
| 50 kgf to less than 65 kgf . . . effective | "B" |
| 65 kgf or higher . . . excellent effect | "A" |

The results of the above tests are given in Table 13.

TABLE 13

| | Fifth Lubricant Composition | | | | | | | | |
|---|---|---|---|---|---|---|---|---|---|
| | Example | | | | | | Comparative Example | | |
| | 1 | 2 | 3 | A | 5 | 6 | 1 | 2 | 3 |
| NiDTC | 2 | 2 | 3 | 7 | 2 | 2.1 | 2 | | commercial grease, sulfur-phosphorus extreme-pressure additive |
| MoDTP | 1 | 2 | 3 | 7 | | | | | |
| ZnDTP | | | 2 | 4 | 4 | | | | |
| Four-ball test | A | A | A | B | A | B | B | D | D |
| Bearing temperature | B | A | A | B | A | B | C | D | C |

Note)
The unit for the numerals of NiDTC, MoDTP, and ZnDTP is wt %.

It was ascertained from the results given in Table 13 that in the case of using an organonickel compound singly, the content thereof is desirably higher than 2% by weight. The results further show that the use thereof in combination with an MoDTP or ZnDTPT was more effective.

EXAMPLES OF THE SIXTH LUBRICANT COMPOSITION

Test 1

Of embodiments of the sixth lubricant composition, those containing an organotellurium compound were subjected to the same test as that conducted for the fifth lubricant composition.

Namely, test greases were prepared using the base oils, thickeners, organotellurium compound, rust preventive, and antioxidant shown in Table 14. A rolling bearing (designation: 6305VVC3E) was filled with 3 g of each test grease, and the shaft was rotated at a high rotational speed of 10,000 rpm under the conditions of a temperature of 170° C., a radial load of 10 kgf, and an axial load of 100 kgf. The time period required for the bearing to seize was measured. The results of the measurement are given in Table 14.

TABLE 14

| | Sixth Lubricant Composition | | | | |
|---|---|---|---|---|---|
| Example | 1 | 2 | 3 | 4 | 5 |
| Thickener | diurea (aromatic) | diurea (aromatic) | diurea (aliphatic) | diurea (alicyclic) | diurea (alicyclic) |
| Base oil | synthetic hydro-carbon oil | synthetic hydro-carbon oil + ester oil | mineral oil | ether oil + mineral oil | ether oil |
| Viscosity of base oil, 40° C., $mm^2/s$ | 150 | 200 | 250 | 250 | 80 |
| Organo-tellurium | tellurium diethyldi-thio-carbamate | tellurium diethyldi-thio-carbamate | tellurium diethyldi-thio-carbamate | tellurium diethyldi-thio-carbamate | tellurium diethyldi-thio-carbamate |
| Amount (wt %) | 1 | 2.5 | 6 | 1.5 | 4 |
| Rust preventive | barium sulfonate | barium sulfonate | barium sulfonate | barium sulfonate | barium sulfonate |
| Amount (wt %) | 1 | 1 | 1 | 1 | 1 |

TABLE 14-continued

| | Sixth Lubricant Composition | | | | |
|---|---|---|---|---|---|
| Example | 1 | 2 | 3 | 4 | 5 |
| Antioxidant | 2,6-di-tert-dibutyl-cresol | 2,6-di-tert-dibutyl-cresol | none | none | none |
| Amount (wt %) | 1 | 1 | | | |
| Seizure time (h) | 650 | 690 | 480 | 700 | 1200 |

A comparison between the results given in Table 14 and Table 12 shows that the greases of the Examples according to the present invention had far longer seizure lives than the greases of the Comparative Examples and the commercial greases for high-temperature use, irrespective of the kinds of the base oils and thickeners and the combinations of these. The tables further show that even the greases containing no antioxidant (Examples 3, 4, and 5) had an excellent anti-seizing performance.

Test 2

The following test was conducted with respect to the sixth lubricant composition containing an organometallic compound wherein the metal was tellurium, selenium, copper, or iron.

[Production of Grease]

Experimental Production of Base Grease

A grease having the composition shown below was produced as shown in Tables 15 and 16, and used as a base grease.

Thickener: diurea compound

Amount of thickener: 30% by weight

Base oil: mineral oil (138 $mm^2$/sec, 40° C. )

Production of Grease Compositions to be Subjected to Examples and Comparative Examples An amine type antioxidant (PANA) was added to the same mineral oil as described above in an amount of 2% by weight based on the total grease composition amount together with a metal-DTC, an MoDTP, and a ZnDTP in the amounts shown in Tables 15 and 16 to prepare additive-containing mineral oils. The additive-containing mineral oils were added to the above base grease in such an amount as to result in a thickener amount of 10% by weight, and the resulting mixtures were stirred until they became homogeneous. This stirring may be conducted with heating at 80 to 130° C. for several tens of minutes (under temperature and time conditions which do not result in base oil deterioration) in order to enhance homogeneity. Thereafter, each mixture was treated with a three-roll mill from one to three times to homogenize the same. Thus, grease compositions were obtained.

For the purpose of comparison, a commercial grease containing a sulfur-phosphorus compound extreme-pressure additive was used (Comparative Example 7).

TABLE 15

| | Sixth Lubricant Composition | | | | | | | | | | |
|---|---|---|---|---|---|---|---|---|---|---|---|
| | Example | | | | | | | | | | |
| | 1 | 2 | 3 | 4 | 5 | 6 | 7 | 8 | 9 | 10 | 11 |
| Metal-DTC | Te 2 | Te 2 | Te 3 | Cu 3 | Se 3 | Te 4 | Fe 3 | Se 3 | Fe 4 | Cu 4 | Se 4 |
| MoDTP | | | 3 | 3 | 3 | 4 | 3 | 3 | | | |
| ZnDTP | | 4 | | | | 3 | 2 | 2 | | | |
| Four-ball test | B | A | A | B | A | A | B | B | B | B | B |
| Bearing temperature | B | A | A | A | B | A | A | A | B | B | B |

Note)
The unit for the numerals of Metal-DTC, MoDTP, and ZnDTP is wt %.

TABLE 16

| | Sixth Lubricant Composition | | | | | | |
|---|---|---|---|---|---|---|---|
| | Comparative Example | | | | | | |
| | 1 | 2 | 3 | 4 | 5 | 6 | 7 |
| Metal-DTC | | Mo 3 | Mo 3 | Mo 3 | | Mo 3 | commercial grease, sulfur-phosphorus compound extreme-pressure additive |
| MoDTP | | | 3 | 3 | 3 | | |
| ZnDTP | | | | 2 | 2 | 2 | |
| Four-ball test | D | C | C | B | B | D | D |
| Bearing temperature | D | C | C | C | C | D | C |

Note) The unit for the numerals of NiDTC, MoDTP, and ZnDTP is wt %.

In the tables, the symbol of element in each metal-DTC indicates the metal forming the salt with DTC. The MoDTC used in Comparative Examples is the same as that used in the Test 2 for the fifth lubricant composition.

The grease compositions thus obtained each had a worked penetration in the range of from No. 2 to No. 1.

These grease compositions were evaluated for the effect of inhibiting heat generation and for load bearing property through a four-ball test in the same manner as in the Test 2 for the fifth lubricant composition. The results of the above measurements are given in Tables 15 and 16. The test results show that since the lubricant compositions of the present invention contained any one of the dithiocarbamic acid salts of Te, Se, Cu, and Fe, they were excellent in the effect of inhibiting heat generation and in load bearing property as compared with the commercial grease and with the comparative grease compositions containing representative conventional extreme-pressure agents, i.e., an MoDTC alone and mixtures of the MoDTC with at least either of an MoDTP and a ZnDTP. The results further show that the use of any one of the dithiocarbamic acid salts of Te, Se, Cu, and Fe in combination with an MoDTP or a ZnDTP was effective in further improving the above effects.

Although the present invention was described above with respect to greases as examples thereof, the present invention should not be construed as being limited to greases and is widely applicable to all other lubricants.

POSSIBILITY OF INDUSTRIAL APPLICATION

As described above, the lubricant compositions of the present invention not only can impart far higher load bearing properties and extreme-pressure properties than conventional ones to members to which the compositions are applied, but also show an excellent lubricating performance at high temperatures. Therefore, the lubricant compositions are usable for application to rolling mechanical parts and mechanical parts which roll while sliding, such as rolling bearings, e.g., tapered roller bearings and four-point contact ball bearings, constant-velocity joints (CVJ), linear guides (L/G) for use in positioning apparatus, ball screws (B/S), and cross roller bearings for use in megatorque motors, and as various lubricating oils such as engine oils and gear oils, etc.

We claim:

1. A lubricant composition comprising two or more organometallic compounds selected from organometallic compounds wherein the metal is a transition metal or semimetal belonging to the fourth or a later period of the periodic table in the longer form, or zinc.

2. The lubricant composition as claimed in claim 1, characterized in that the organometallic compounds are a dithiocarbamic acid compound represented by the following general formula (I) and a dithiophosphoric acid compound represented by general formula (II):

(I)

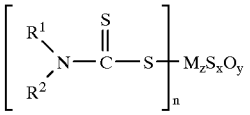

(II)

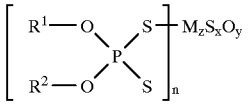

n = 2, 3, 4
x, y, z = 0, 1, 2, 3, 4 wherein M is a metal, and $R^1$ and $R^2$ each is an alkyl group, a cycloalkyl group, an alkenyl group, an aryl group, an alkylaryl group, or an arylalkyl group and may be the same or different.

3. The lubricant composition as claimed in claim 2, characterized in that in general formula (I) or (II), M is antimony, bismuth, tin, nickel, tellurium, selenium, iron, or zinc.

4. The lubricant composition as claimed in any one of claims 1 to 3, characterized in that the content of the organometallic compounds is from 0.3 to 20% by weight based on the total amount of the lubricant composition.

5. A lubricant composition comprising an organonickel compound and at least one member selected from dithiophosphoric acid zinc compounds and dithiophosphoric acid molybdenum compounds, characterized in that the content of the organonickel compound alone is higher than 2% by weight based on the total amount of the lubricant composition.

6. A lubricant composition comprising at least one dithiocarbamic acid compound represented by the following general formula (XII):

(XII)

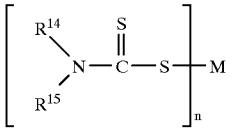

wherein n=2, 3, or 4, M is a metal selected from tellurium, selenium and iron, and $R^{14}$ and $R^{15}$ each is an alkyl group or an aryl group and may be the same or different.

7. A lubricant composition comprising a nickel dithiocarbamate represented by the following general formula (XI) and at least one member selected from dithiophosphoric acid zinc compounds and dithiophosphoric acid molybdenum compounds:

(XI)

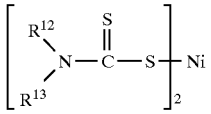

wherein $R^{12}$ and $R^{13}$ each is an alkyl group or an aryl group and may be the same or different, and wherein the content of the nickel dithiocarbamate is higher than 2% by weight based on the total weight of the lubricant composition.

8. The lubricant composition as claimed in claim 6, characterized in that it contains the dithiocarbamic acid compound and at least one member selected from dithiophosphoric acid zinc compounds and dithiophosphoric acid molybdenum compounds.

9. The lubricant composition as claimed in claims 6 to 8, characterized in that the content of the dithiocarbamic acid compound is from 1 to 20% by weight.

* * * * *